US005870661A

United States Patent [19]

Menzel et al.

[11] Patent Number: 5,870,661

[45] Date of Patent: Feb. 9, 1999

[54] APPARATUS AND METHOD FOR CONTROLLING MEDIA TEMPERATURE IN AN IMAGING APPARATUS

[75] Inventors: Paul J. Menzel, Wilsonville; Beta Y. Ni, Sherwood; Robert C. Tidrick, Portland, all of Oreg.

[73] Assignee: Tektronix, Inc., Wilsonville, Oreg.

[21] Appl. No.: 73,069

[22] Filed: May 4, 1998

[51] Int. Cl.[6] ..... G03G 15/20

[52] U.S. Cl. ..... 399/400; 399/401; 399/92

[58] Field of Search ..... 399/400–402, 399/330, 331, 306, 309, 320, 92, 94; 219/216

[56] References Cited

U.S. PATENT DOCUMENTS

| | | | |
|---|---|---|---|
| 4,369,729 | 1/1983 | Shigenobu et al. . | |
| 4,493,548 | 1/1985 | Ateya . | |
| 4,822,977 | 4/1989 | Leising et al. | 219/216 |
| 4,963,943 | 10/1990 | Tamary | 355/290 |
| 5,130,752 | 7/1992 | Morishita et al. | 355/274 |
| 5,166,735 | 11/1992 | Malachowski . | |
| 5,247,336 | 9/1993 | Mills, III | 355/285 |
| 5,550,621 | 8/1996 | Ogawahara | 355/285 |
| 5,652,949 | 7/1997 | Ogawa et al. | 399/69 |
| 5,671,473 | 9/1997 | Yamada et al. | 219/216 X |
| 5,678,161 | 10/1997 | Kurotaka et al. | 399/400 |
| 5,693,243 | 12/1997 | Kueppers et al. | 219/216 |
| 5,771,434 | 6/1998 | Hokari | 399/400 |
| 5,812,920 | 9/1998 | Mizude et al. | 399/400 X |

*Primary Examiner*—R. L. Moses
*Attorney, Agent, or Firm*—Charles F. Moore

[57] ABSTRACT

An improved apparatus and method for controlling media temperature to prevent image offset and degloss in an electrostatic image forming apparatus are provided. The apparatus and method utilize a plurality of media support surfaces in the pre-nip media path to reduce heat transfer to the media in this region. An insulating channel is provided beneath the media supports to thermally isolate the media supports. One or more insulating plates may also be provided between the rollers of the fusing nip and the media support surfaces to further reduce heat transfer from the fusing members to the media support surfaces and media.

20 Claims, 2 Drawing Sheets

APPARATUS AND METHOD FOR CONTROLLING MEDIA TEMPERATURE IN AN IMAGING APPARATUS

FIELD OF INVENTION

This invention relates generally to an apparatus and method for controlling media temperature in an imaging apparatus and, more specifically, to a media temperature control apparatus and method that controls media temperature prior to the media entering a fusing nip in a duplexing operation.

BACKGROUND OF THE INVENTION

In electrostatic or electrophotographic image forming apparatus, such as monochrome and color laser printers and photocopiers, it is well known to pass imaged media through a fusing nip to fuse the image into the media. The fusing nip is typically created by biasing two rollers together. In some fusing systems both rollers are positively heated. In other systems one roller is positively heated (the heated roller) while the other is unheated (the pressure roller). Of course it will be appreciated that the "unheated" pressure roller is itself heated by contact with the heated roller. The side of the media containing the toner image is contacted by the heated roller to fuse the toner into the media. The fusing process thus utilizes a combination of elevated temperature and pressure within the fusing nip to accomplish the desired amount of image fusing.

One area in which the fusing process can present problems is duplex imaging or duplexing. Duplexing involves imaging on both sides of a sheet of media. In many duplexing systems a first toner image is formed and fused onto a first side of the media, and a second toner image is then formed and fused onto the second side of the media. In this duplexing process, the first toner image must pass through the heated and pressurized fusing nip a second time during fusing of the second image.

The fuser in many duplexing systems utilizes a heated roller and an unheated pressure roller. In the second stage of the duplexing process, the first image is contacted by the pressure roller during its second pass through the fusing nip. When the combined temperature of the pressure roller and the media rises above a particular level, the first toner image can partially or completely offset or transfer onto the pressure roller. In a worst case scenario, the media will wrap around the pressure roller and cause a media jam.

Toner particles are characterized by a cold offset temperature, below which the toner is not fused into the media. The cold offset temperature of a toner is determined by the composition of the toner and the parameters of the fusing system, such as the temperature, pressure, width of the fusing nip and the media speed through the nip. Toner particles are also characterized by a glass transition temperature, above which the toner becomes tacky and is prone to offset. For most color toners, the glass transition temperature is between about 65° C. and about 70° C.

For color toner, the proper fusing temperature in a typical fusing system is generally between about 140° C. and about 170° C. for many low volume photocopiers and laser printers. This fusing temperature is a combination of the temperature of the heated roller contacting the toner and the media temperature. In the case of duplexing, if the fusing system does not adequately control the combined temperature of the pressure roller and the media entering the fusing nip, this combined temperature can exceed the glass transition temperature of the toner being used. When this occurs, the first image can degloss and offset onto the pressure roller during the second pass of the media through the fusing nip.

In the prior art, the above problem has been addressed by employing various means of sensing and/or actively cooling the temperature of the pressure roller. An example of this approach is found in the U.S. Pat. No. 5,247,336 to Mills (the '336 patent). The '336 patent discloses a pressure roller that includes an internally mounted fan that draws air into and blows air out of the hollow interior of the pressure roller to control the pressure roller temperature.

While the components and system described in the '336 patent generally achieve the desired result, they require expensive and often bulky parts to be added to the printer or photocopier. This approach is especially impractical and disfavored in a compact and low cost desktop printer. Furthermore, even if the pressure roller is maintained at a temperature below the toner cold offset temperature, toner offset and degloss of the first side image may still occur during a long print or copying job, especially when the first side image has a high toner mass coverage. This can occur because the portion of the media path near the heated fusing nip is heated substantially by both fusing rollers, especially during sustained continuous printing or imaging. This radiated heat from the fusing nip can increase the temperature of the first side image by as much as 20°–30° C. or more above room temperature before the media enters the fusing nip. When the combination of the pressure roller temperature and the first side media temperature exceeds the glass transition temperature of the toner, toner offset and degloss of the first side image may still occur even though the pressure roller temperature is below the toner cold offset temperature.

The present invention seeks to overcome the shortcomings of the prior art by providing a simple and low cost apparatus and method for controlling media temperature to prevent offset and degloss of the first side image during duplexing. Media supports are provided upstream from the fusing nip. The media supports include cooling gaps between adjacent supports to minimize heating of the media prior to the fusing nip. An insulating channel is provided beneath the media supports to inhibit heat transfer to the media supports. One or more insulating plates may also be provided to inhibit heat transfer from the fusing rollers to the insulating channel and the media supports.

SUMMARY OF THE INVENTION

It is an aspect of the present invention to provide an improved apparatus and related method for controlling media temperature prior to the media entering a fusing nip in an image forming apparatus.

It is another aspect of the present invention that the apparatus and method maintain the temperature of a toner image below the toner glass transition temperature as the image passes through a fusing nip.

It is yet another aspect of the present invention that the apparatus and method utilize individual media supports to minimize heat transfer to the media.

It is still another aspect of the present invention that the apparatus and method include a channel adjacent to the media supports for thermally isolating the media supports to further reduce heat transfer to the media.

It is a feature of the present invention that the apparatus and method control the media temperature without utilizing active temperature control means, such as temperature sensors and/or positive cooling devises.

It is another feature of the present invention that the apparatus and method prevent first side image degloss and offset during duplex imaging.

It is yet another feature of the present invention that the apparatus and method insulate the pre-fusing nip area of the media path from heat radiated by the fusing rollers.

It is an advantage of the present invention that the apparatus and method avoid toner image offset, deglossing and other image degrading phenomenon.

It is another advantage of the present invention that the apparatus and method utilize simple, compact and low cost components.

To achieve the foregoing and another aspects, features and advantages, and in accordance with the purposes of the present invention as described herein, an improved apparatus and method for controlling media temperature to prevent image offset and degloss in an electrostatic image forming apparatus are provided. The apparatus and method utilize a plurality of media support surfaces in the pre-nip media path to reduce heat transfer to the media in this region. An insulating channel is provided beneath the media supports to thermally isolate the media supports and minimize heat transfer to the media. One or more insulating plates may also be provided between the fuser and the insulating channel and media support surfaces to further reduce heat transfer from the fuser members to the media support surfaces and media.

Still other aspects, features, and advantages of the present invention will become apparent to those skilled in this art from the following description, wherein there is shown and described a preferred embodiment of this invention, simply by way of illustration of one of the modes best suited to carry out the invention. As it will be realized, the invention is capable of other different embodiments and its several details are capable of modifications in various, obvious aspects, all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
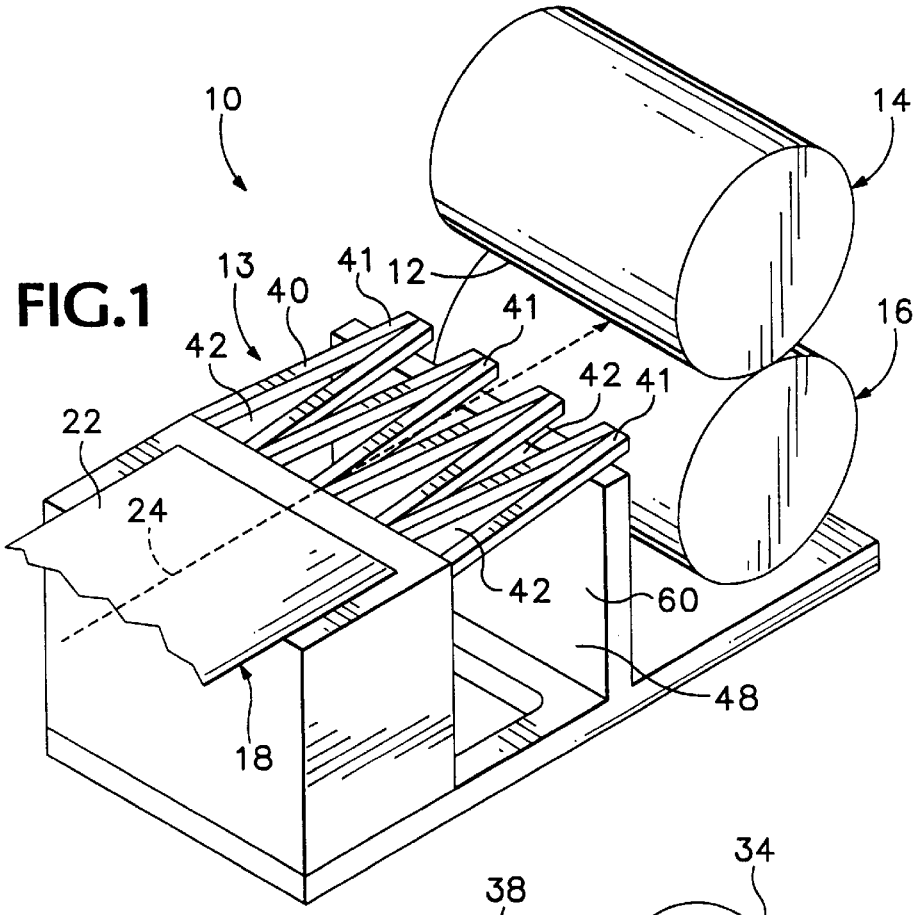
FIG. 1 is a schematic prospective view of a pair of fusing rollers forming a fusing nip and a pre-nip media path that includes media support surfaces and an insulating channel beneath the media supports.

FIG. 1 is a schematic illustration of an image fusing portion 10 of an electrostatic or electrophotographic image forming apparatus that utilizes the apparatus and method for controlling media temperature of the present invention. The following description of a preferred embodiment of the apparatus and method of the present invention refers to its use in a color electrostatic printing apparatus. It will be appreciated, however, that the apparatus and method of the present invention may be used with other types of electrostatic imaging apparatus, such as photocopiers, and with both monochrome and color toner. Accordingly, the following description will be regarded as merely illustrative of one embodiment of the present invention.

With continued reference to FIG. 1, the fusing system 10 includes a fusing nip 12 that is formed by a heated roller 14 and a pressure roller 16. In the preferred embodiment, the heated roller 14 includes an internal heat source (not shown) for maintaining the heated roller at a predetermined elevated temperature. Alternatively, an external heat source, such as a heat lamp, may be utilized to heat the heated roller 14. The preferred fusing temperature of the heated roller 14 is between about 130° C. and about 180° C., and more preferably between about 153° C. and about 162° C. While the pressure roller 16 is not actively heated by a separate heating element, the pressure roller temperature is elevated through contact with the heated roller 14. The pressure roller 16 is biased into contact with the heated roller 14 to create the pressurized fusing nip 12. Preferably, the pressure within the fusing nip 12 is between about 10 psi and about 200 psi, and more preferably between about 70 psi and about 110 psi.

Figure 2:
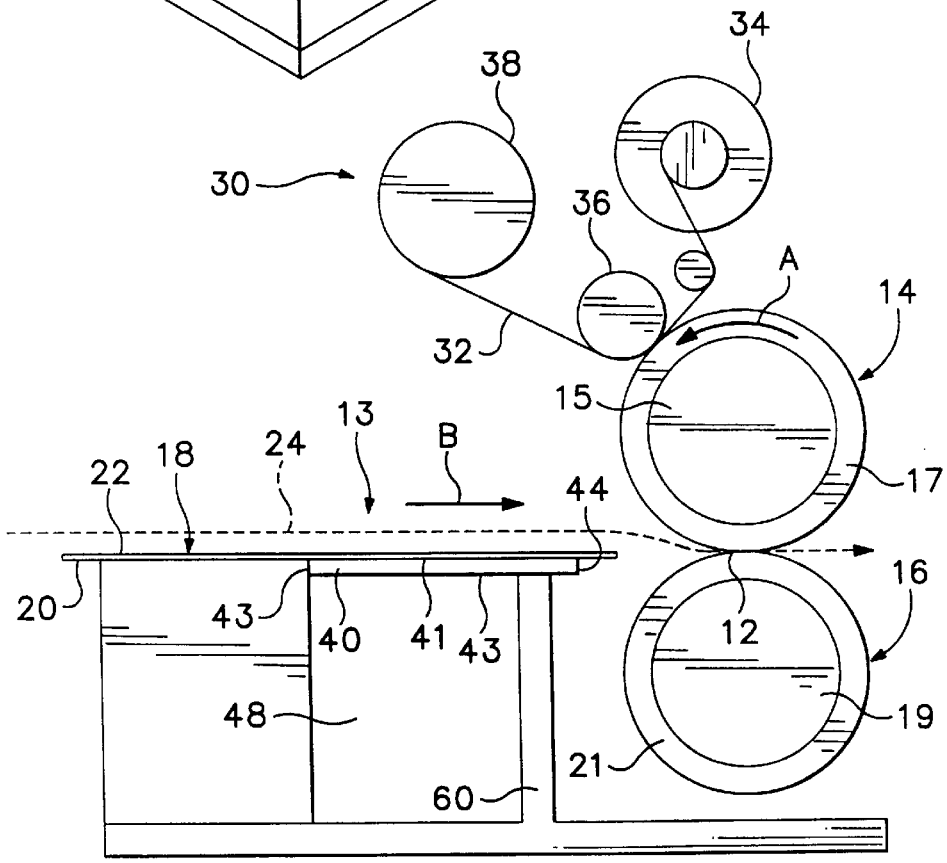
FIG. 2 is a schematic side view of the fusing rollers and the pre-nip media path, and showing a release agent application system contacting the upper heated roller.

With reference now to FIG. 2, a sheet of media 18 having a first side 20 and a second side 22 travels along a media path, generally indicated by the reference numeral 24, toward the fusing nip 12. In FIG. 2, a first toner image has previously been formed and fused into the first side 20. As the media 18 passes through the fusing nip 12 for a second time in a duplex operation, a second toner image on the second side 22 is fused into media 18 by pressurized contact with the heated roller 14. As shown in FIG. 2, the fusing system also includes a release agent application system, generally designated by the reference numeral 30. The release agent application system 30 includes a web 32 that travels from a supply reel 34 to a take up reel 38 through a nip defined by a pinch roller 36 and a surface of the heated roller 14. As the heated roller 14 rotates in the direction of action arrow A, the release agent is transferred from the web 32 to the surface of the heated roller 14. The release agent helps prevent the toner image on the media 18 from offsetting or transferring to the heated roller 14 during the fusing process. Suitable release agents include silicone oil, amino oil, mercapto oil and other release agents known in the art. The preferred release agent is blended amino mercapto silicone oil.

The heated roller 14 is preferably comprised of a metal core, such as aluminum, surrounded by a thermally conductive silicone rubber outer shell 17. The pressure roller 16 is preferably formed from a metallic core, such as aluminum, surrounded by a silicone rubber outer shell 21 having a fluoropolymer coating.

With continued reference to FIG. 2, the media 18 is shown traveling along the media path 24 in the direction of action arrow B toward the fusing nip 12 to fuse a second toner image onto the second side 22. As explained above, the pressure roller 16 is heated by contacting the heated roller 14 and by heat radiated from the heated roller. For proper fusing of the second toner image into the second side 22, the toner temperature must exceed the toner cold offset temperature within the fusing nip 12 through contact with the heated roller 14. The release agent that is applied to the heated roller 14 by the web 32 ensures that the toner image does not offset onto the heated roller 14, even when the toner exceeds its glass transition temperature within the fusing nip 12.

As the media 18 passes through the fusing nip 12, the first image previously fused into the first side 20 of the media experiences an elevated temperature and pressure through contact with the pressure roller 16 in the fusing nip 12. As mentioned above, the pressure roller 16 is heated by contact with the heated roller 14. In general, with the heated roller 14 being heated to a temperature of between about 130° C. and about 180° C., the temperature of the pressure roller 16 will stabilize to between about 10° C. to about 70° C. below the temperature of the heated roller 14, with this temperature difference varying with the fusing nip pressure. In one example utilizing a media speed of about 48 millimeters per second through the fusing nip 12 and a heated roller temperature of about 155° C., the temperature of the pressure roller 16 stabilized at about 112° C. after several print cycles. This temperature of the pressure roller 16 is well below typical toner cold offset temperatures in the range of about 140° C. to about 170° C.

The temperature of the media 18 is also elevated as it nears the fusing nip 12 and passes through a pre-nip portion 13 of the media path 24. The structures that support the media 18 in the pre-nip portion 13 of the media path 24 absorb heat from the pressure roller 16 and the heated roller 14. As the media 18 travels through the pre-nip portion 13 toward the fusing nip 12, heat is transferred from the surfaces of the pre-nip portion 13 to the media. Especially during extended print jobs, heat from the pre-nip portion 13 can raise the temperature of the first side 20 of the media 18 to about 40° C. and higher before the media reaches the fusing nip 12. This temperature combined with a pressure roller temperature of, for example, 110° C. and higher, will cause the toner on the first side 20 of the media 18 to exceed its glass transition temperature. This condition leads to toner offset from the first side 20 of the media 18 onto the pressure roller 16.

As explained above, to address this type of toner offsetting problem, the prior art imaging apparatus have incorporated various temperature sensor and cooling devices to monitor and control the temperature of the pressure roller. These additional systems, components and circuitry add unwanted cost, complexity and bulk to the imaging apparatus. Additionally, especially during continuous printing jobs, the combined temperature of the media and the pressure roller can still exceed the glass transition temperature of the toner.

With reference now to FIG. 1, the present invention provides a simple, low cost apparatus and method for controlling the temperature of the media prior to its entry into the fusing nip 12 to prevent the toner on the first side 20 of the media from exceeding its glass transition temperature. More specifically, and in an important aspect of the present invention, a plurality of media supports 40 are provided upstream from the fusing nip 12 to support the media 18 as it advances through a pre-nip portion 13 of the media path 24. In the preferred embodiment, each of the media supports 40 is generally rectangular in cross-section and includes an upper surface 41 for supporting the media 18 and an opposing lower surface 43 (see FIG. 2). It will be appreciated that other embodiments of media supports having different cross-sectional shapes and dimensions may be utilized to practice the present invention. Advantageously, the media supports 40 include cooling gaps 42 between adjacent supports that minimize heat transfer to the media 18. The cooling gaps 42 minimize contact between the first side 20 of the media 18 and the heat-transferring upper surfaces 41 of the media supports 40 to reduce heat transfer to the media. The media supports 40 may be formed from any suitable thermally-stable material having a low thermal conductivity, such as a polyimide, polyphenylene sulfide (PPS), polysulfone and polybenzimidazole (PBI). The preferred material for the media supports 40 is polybutylene tetrephthalate (PBT). The air in the cooling gaps 42 is much less thermally conductive and has a lower thermal mass than the solid surfaces of the media supports 40. In this manner, the heat transfer to the media 18 in the pre-nip portion 13 is greatly reduced as compared to utilizing a continuous or solid media support surface in the pre-nip portion.

In another important aspect of the present invention, a channel 48 is provided beneath the media supports 40 to thermally isolate the supports from the rollers 14, 16. In the preferred embodiment, the channel 48 is an open space that allows air to freely flow and conduct heat away from the media supports 40. Alternatively, the channel 48 may be partially or completely filled with a low thermal mass, thermally-stable material.

Figure 4:
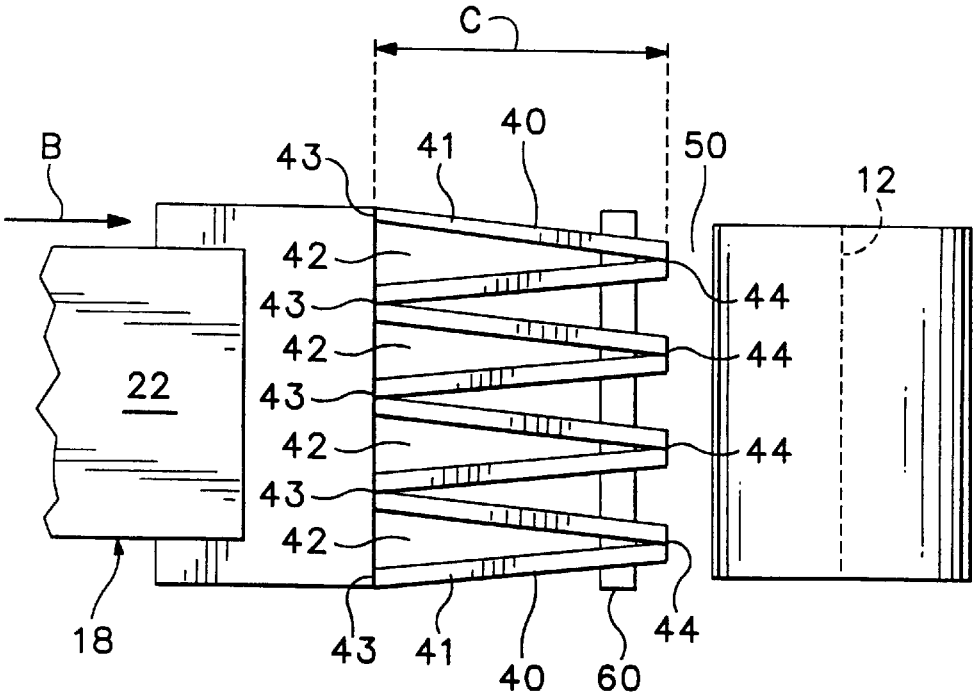
FIG. 4 is a schematic top view of the media support surfaces and their position relative to the fusing nip.

With reference now to FIG. 4, the media 18 travels in the direction of action arrow B from left to right across the media supports 40 toward the fusing nip 12. As shown in FIG. 4, the media supports 40 are preferably angled away from the direction of travel B of the media 18. In this manner, as the media 18 advances from a leading edge 43 of the media supports 40 to a trailing edge 44, a fixed position on the first side 20 of the media (see FIG. 2) is not in continuous contact with the surface of a media support 40. This helps to avoid localized heating that can create glossy spots and/or streaks in the first image on the first side 20. It will be appreciated, however, that the media supports 40 may also be positioned substantially parallel to the direction of travel B of the media. This alternative arrangement of the media supports 40 combined with the adjacent channel 48 still substantially reduces the heat transfer to the first side 20 of the media 18.

With continued reference to FIG. 4, the media supports 40 extend a distance C in the direction of travel B of the media 18. To provide sufficient cooling of the media 18, the distance C is preferably at least about 15 mm., and more preferably about 29 mm. It will be appreciated that the media supports 40 may extend any suitable distance C longer than 29 mm, if desired. The trailing edges 44 of the media supports 40 are also spaced from the fusing nip 12 to create a ventilation area 50. The ventilation area 50 allows air to flow between the media supports 40 and the fusing nip 12 to enhance heat dissipation from the vicinity of the pre-nip portion 13 of the paper path. In the preferred embodiment, the distance between the leading edges 43 of the media supports and the fusing nip 12 is at least about 30 mm., and more preferably about 54 mm. A fan or other air moving device (not shown) may also be utilized to positively move air through the ventilation area 50 and/or the channel 48.

With reference now to FIGS. 1 and 2, to further reduce heat transfer to the media 18 in the pre-nip portion 13 of the media path 24, an insulator may be provided between the pressure roller 16 and at least a portion of the media supports 40. In the preferred embodiment, the insulator comprises a first plate 60 that depends downwardly from the media supports 40 and extends substantially parallel to the fusing nip 12. Advantageously, the first plate 60 blocks heat radiated from the pressure roller 16 from entering the pre-nip portion 13 of the media path 24. The preferred material for the first insulating plate 60 is PBT.

Figure 3:
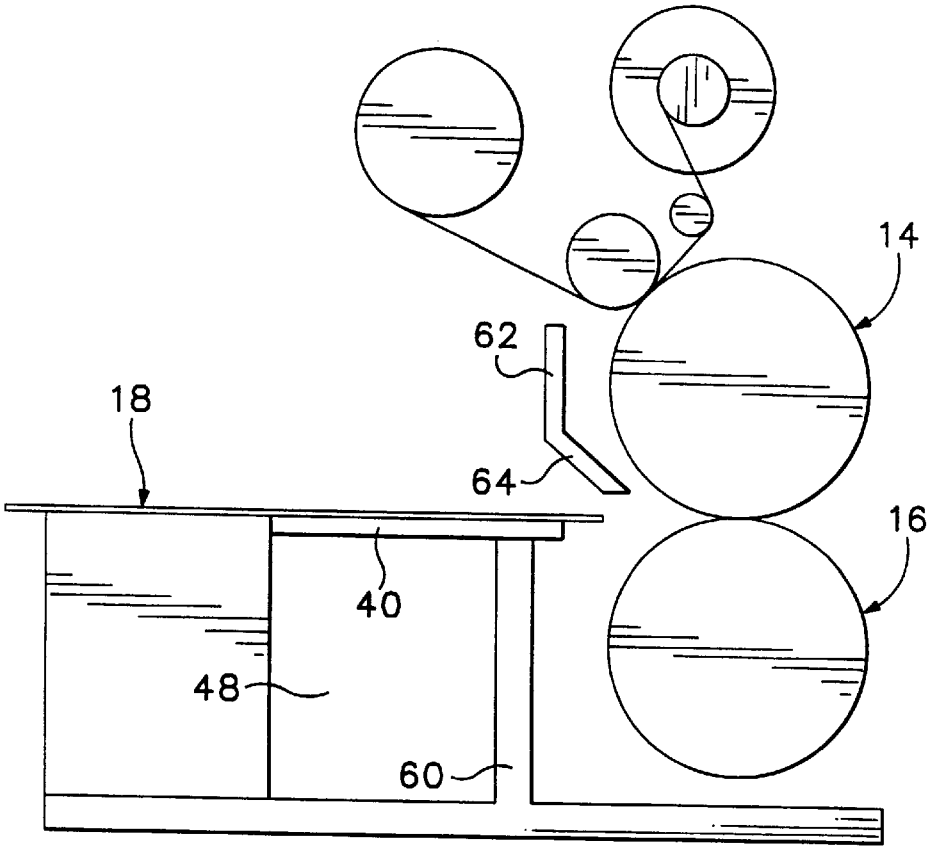
FIG. 3 is a schematic side view of an alternative embodiment of the fusing system shown in FIG. 2 in which an additional insulating plate is positioned between the upper heated fusing roller and the pre-nip media path.

In an alternative embodiment shown in FIG. 3, a second insulator may be provided between the heated roller 14 and at least a portion of the media supports 40. The second insulator preferably comprises a second plate 62 that extends substantially parallel to the axis of rotation of the heated roller 14 to absorb heat radiated from the heated roller. The second plate 62 may also include an angled flange 64 that extends downwardly and toward the fusing nip 12 to further insulate the pre-nip portion 13 of the media path 24 from radiated heat. The preferred material for the second insulating plate 62 is PBT.

While the invention has been described above with references to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace the use of these other inks and all other changes, modifications and variations that may occur to one of skill in the art upon a reading of the disclosure. All patent applications and patents cited herein are incorporated by reference in their entirety.

What is claimed is:

1. A media substrate temperature control apparatus for controlling a temperature of a media substrate in an image forming apparatus, the media substrate temperature control apparatus comprising:

a) a fusing nip;

b) a media path that extends through the fusing nip;

c) a plurality of media supports upstream from the fusing nip along the media path for supporting the media substrate, the media supports including cooling gaps therebetween; and d) a channel adjacent to the media supports for minimizing heat transfer to the media supports and to the media substrate.

2. The media substrate temperature control apparatus of claim 1, wherein the fusing nip includes a first fusing surface in contact with a second fusing surface, and further including an insulator between the first fusing surface and at least a portion of the media supports, whereby heat transfer from the first fusing surface to the media supports is inhibited.

3. The media substrate temperature control apparatus of claim 2, wherein the insulator comprises a first insulator, and further including a second insulator between the second fusing surface and at least a portion of the media supports, whereby heat transfer from the second fusing surface to the media supports is inhibited.

4. The media substrate temperature control apparatus of claim 3, wherein the first insulator comprises a plate that extends substantially parallel to the fusing nip.

5. The media substrate temperature control apparatus of claim 4, wherein the plate comprises a first plate and the second insulator comprises a second plate that extends substantially parallel to the fusing nip.

6. The media substrate temperature control apparatus of claim 5, wherein the first plate depends downwardly from the media supports.

7. The media substrate temperature control apparatus of claim 6, wherein the second plate includes an angled flange that is angled toward the fusing nip.

8. The media substrate temperature control apparatus of claim 1, further comprising a ventilation area between the media supports and the fusing nip, the ventilation area allowing air to flow between the media supports and the fusing nip.

9. The media substrate temperature control apparatus of claim 8, wherein the media supports extend at least 15 mm. in a direction of travel of the media substrate along the media path.

10. The media substrate temperature control apparatus of claim 9, wherein a distance between a leading edge of the media supports and the fusing nip is at least 30 mm.

11. The media substrate temperature control apparatus of claim 10, further comprising a fan that moves air through the ventilation area.

12. A method of controlling a temperature of a media substrate prior to the media substrate entering a fusing nip in an image forming apparatus, the method comprising the steps of:

a) advancing the media substrate along a media path toward the fusing nip;

b) providing a plurality of media supports upstream from the fusing nip, the media supports including a surface for supporting the media substrate as it advances along the media path;

c) providing a cooling gap between adjacent media supports; and d) insulating the media supports to minimize heating of the media substrate.

13. The method of claim 12, wherein the step of insulating the media supports further comprises the step of providing a channel beneath the plurality of media supports to inhibit heat transfer to the media supports.

14. The method of claim 13, further including the steps of:

creating the fusing nip by biasing a first fusing surface against a second fusing surface; and insulating at least a portion of the media supports from the first fusing surface to inhibit heat transfer from the first fusing surface to the media supports.

15. The method of claim 14, wherein the step of insulating at least a portion of the media supports from the first fusing surface further comprises the step of providing an insulator between the first fusing surface and at least a portion of the media supports.

16. The method of claim 15, further including the step of:

insulating at least a portion of the media supports from the second fusing surface to inhibit heat transfer from the second fusing surface to the media supports.

17. The method of claim 16, wherein the step of providing an insulator between the first fusing surface and at least a portion of the media supports further comprises the step of providing a first insulator, and wherein the step of insulating at least a portion of the media supports from the second fusing surface further comprises the step of providing a second insulator between the second fusing surface and at least a portion of the media supports.

18. The method of claim 12, further including the step of providing an open ventilation area between the media supports and the fusing nip.

19. The method of claim 18, further including the step of extending the media supports at least 15 mm. in the direction of travel of the media substrate along the media path.

20. The method of claim 19, further including the step of moving air through the ventilation area to dissipate heat from the ventilation area.

* * * * *